US006953162B2

(12) United States Patent
Hans

(10) Patent No.: US 6,953,162 B2
(45) Date of Patent: Oct. 11, 2005

(54) FUEL INJECTOR VALVE

(75) Inventor: Waldemar Hans, Bamberg (DE)

(73) Assignee: Robert Bosch GmbH, Stuttgart (DE)

( * ) Notice: Subject to any disclaimer, the term of this patent is extended or adjusted under 35 U.S.C. 154(b) by 150 days.

(21) Appl. No.: 10/258,408

(22) PCT Filed: Feb. 21, 2002

(86) PCT No.: PCT/DE02/00626

§ 371 (c)(1),
(2), (4) Date: Mar. 26, 2003

(87) PCT Pub. No.: WO02/066820

PCT Pub. Date: Aug. 29, 2002

(65) Prior Publication Data

US 2003/0168533 A1 Sep. 11, 2003

(30) Foreign Application Priority Data

Feb. 21, 2001 (DE) ..... 101 08 195

(51) Int. Cl.[7] ..... B05B 1/30; F02M 59/00; F02M 61/20

(52) U.S. Cl. ..... 239/585.1; 239/585.3; 239/585.4; 239/585.5; 239/533.1; 239/533.2; 239/533.9

(58) Field of Search ..... 239/585.1–585.5, 239/533.2, 533.3, 533.11, 88–93, 600; 29/890.124, 890.127; 251/129.15, 129.21, 127

(56) References Cited

U.S. PATENT DOCUMENTS

| | | | | | |
|---|---|---|---|---|---|
| 4,294,215 | A | | 10/1981 | Steinbrenner | |
| 5,755,386 | A | * | 5/1998 | Lavan et al. | 239/585.4 |
| 5,937,887 | A | * | 8/1999 | Baxter et al. | 137/15.18 |
| 5,979,866 | A | * | 11/1999 | Baxter et al. | 251/129.21 |
| 5,996,911 | A | * | 12/1999 | Gesk et al. | 239/585.1 |
| 6,328,232 | B1 | * | 12/2001 | Haltiner et al. | 239/585.1 |

FOREIGN PATENT DOCUMENTS

| | | |
|---|---|---|
| DE | 196 00 403 | 8/1996 |
| JP | 10 115 267 | 5/1998 |
| JP | 2000 337 227 | 12/2000 |

* cited by examiner

*Primary Examiner*—Davis Hwu
(74) *Attorney, Agent, or Firm*—Kenyon & Kenyon

(57) ABSTRACT

A fuel injector for the direct injection of fuel into the combustion chamber of a mixture-compressing internal combustion engine having external ignition, includes a valve housing formed from a nozzle body, and a sealing ring which seals the fuel injector from a cylinder head of the internal combustion engine. In the mounted state, a radial extension of a stamping sleeve that is disposed on the intake side of the sealing ring acts upon the sealing ring in such a way that the axial extension of the sealing ring is reduced in favor of the radial extension of the sealing ring relative to the unstrained state of the sealing ring.

8 Claims, 2 Drawing Sheets

FUEL INJECTOR VALVE

FIELD OF THE INVENTION

The present invention relates to a fuel injector.

BACKGROUND INFORMATION

From German Published Patent Application No. 196 00 403, for example, an electromagnetic fuel injector and an appropriate structure for its mounting are known which satisfy the requirements with respect to the scaling effect, thermal resistance and pressure resistance for an internal combustion engine having direct fuel injection. Particular attention is paid in this respect to the sealing of the region directly adjacent to the cylinder where the electromagnetic fuel injector is mounted, as well as a region more distant from it. As a result, according to the present invention, a first sealing section including a first sealing ring, which is designed as a wavy washer, is positioned at a location close to the cylinder and between the fuel injector and the cylinder head. Moreover, a second sealing section including a second sealing ring, which is also designed as a wavy washer, is positioned at a location that is at a greater distance from the cylinder than the first sealing section.

Disadvantageous in the fuel injector known from German Published Patent Application No. 196 00 403, on the one hand, are the manufacturing complexity and the high production costs of the sealing rings caused by the refined materials, such as silver-plated INCONEL.

On the other hand, a high sealing effect always necessitates a higher installation effort, requiring great mechanical forces in the installation and possibly resulting in damage to the components.

SUMMARY OF THE INVENTION

The fuel injector according to the present invention has the advantage over the related art that a stamping sleeve is able to press the sealing ring into a receiving bore of the cylinder head of the internal combustion machine in such a way that its axial extension may be reduced in favor of its radial diameter such as to obtain a reliable sealing effect.

It is especially advantageous that the stamping sleeve is able to be manufactured in an uncomplicated manner and may be disposed between the sealing ring and a housing-end piece of the fuel injector.

Using a shim plate on the downstream side of the sealing ring is especially advantageous since this measure largely prevents a destructive contact between the sealing ring and the mixtures present in the combustion chamber.

The formation of a gap between the nozzle body and the wall of the receiving bore in the cylinder head advantageously allows a pressure-assisted sealing effect during operation of the fuel injector.

DETAILED DESCRIPTION

Figure 1:
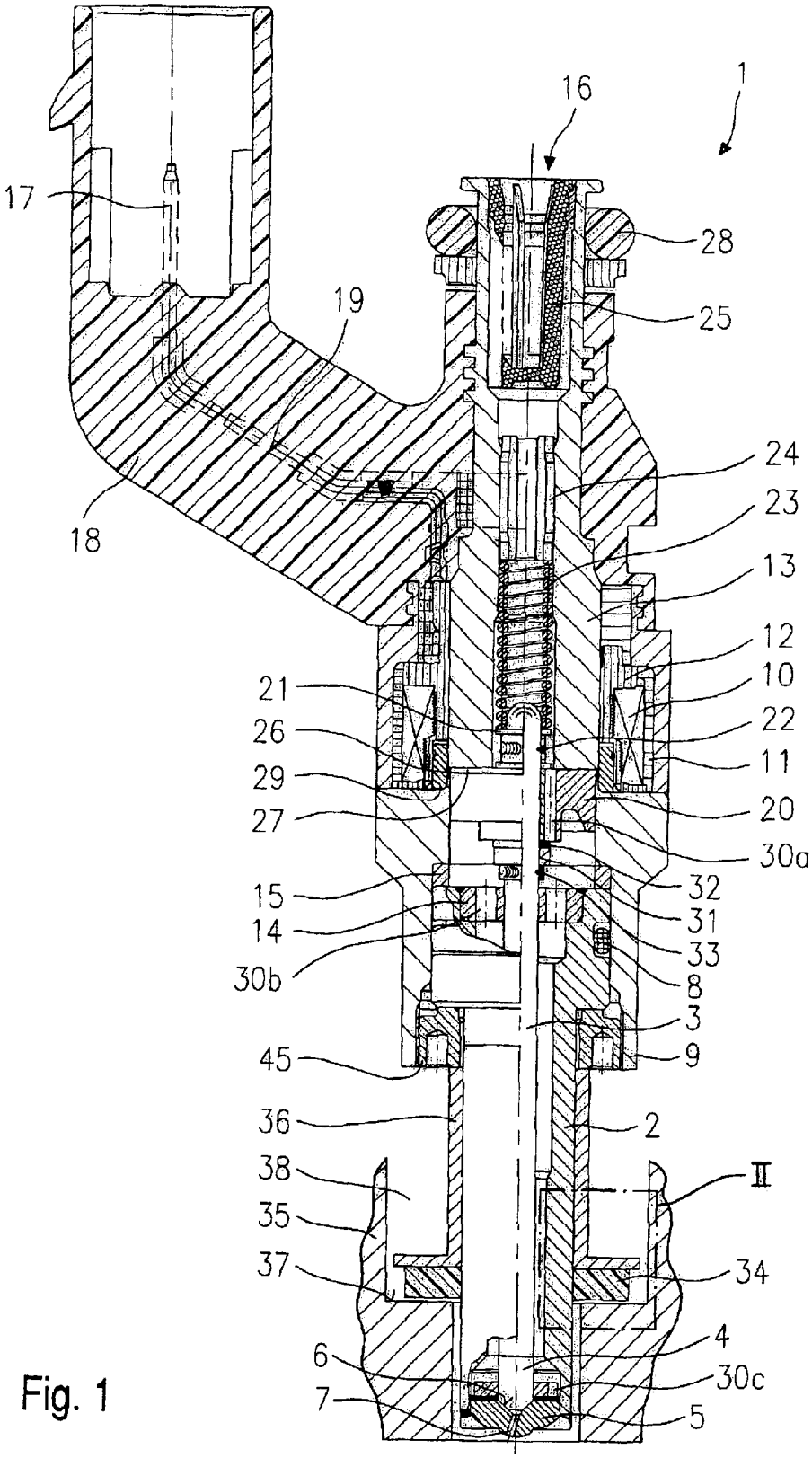
FIG. 1 shows a schematic section through a first exemplary embodiment of a fuel injector according to the present invention in an overall view.

A fuel injector 1 is designed in the form of an injector for fuel-injection systems of mixture-compressing internal combustion engines having externally supplied ignition. Fuel injector 1 is suitable for the direct injection of fuel into a combustion chamber, not further shown, of an internal combustion engine.

Fuel injector 1 includes a nozzle body 2, in which a valve needle 3 is positioned. Valve needle 3 is in operative connection with a valve-closure member 4 that cooperates with a valve-seat surface 6, arranged on a valve-seat member 5, to form a sealing seat. Fuel injector 1 in the exemplary embodiment is an inwardly opening fuel injector 1, which has a spray-discharge opening 7.

Nozzle body 2 is sealed by a seal 8 from an external pole 9 of a magnetic coil 10 and by a sealing ring 34 from a cylinder head 35 of the internal combustion engine. Sealing ring 34 is preferably made of Teflon® so as to obtain a reliable sealing effect. According to the present invention, during the installation, sealing ring 34 is placed at a shoulder 37 of a receiving bore of cylinder head 35, by a stamping sleeve 36, as shown in FIG. 1. In the process, stamping sleeve 36 is supported on the inflow side by a housing-end piece 45, for example.

At the time represented in FIG. 1, fuel injector 1 has not yet assumed its final installation position, so that cylinder head 35 and valve-seat member 5 of fuel injector 1 are not yet in flush position. Once fuel injector 1 is pressed further into receiving bore 38, the desired sealing effect is obtained by compression of sealing ring 34. A detailed representation of sealing ring 34 and its functioning can be gathered from the description of FIGS. 2A and 2B.

Magnetic coil 10 is encapsulated in a coil housing 11 and wound on a bobbin 12, which lies adjacent to an internal pole 13 of magnetic coil 10. Internal pole 13 and external pole 9 are separated from each other by a gap 26 and are supported on a connecting component 29. Magnetic coil 10 is energized via an electric line 19 by an electric current, which can be supplied via an electrical plug contact 17. A plastic jacket 18, which may be sprayed onto internal pole 13, encloses plug contact 17.

Valve needle 3 is guided in a valve needle guide 14, which is designed as a disk. A paired adjustment disk 15 is used to adjust the (valve) lift. An armature 20 is on the other side of adjustment disk 15. It is connected by force-locking to valve needle 3 via a first flange 21, and valve needle 3 is connected to first flange 21 by a welded seam 22. Supported on first flange 21 is a restoring spring 23 which, in the present design of fuel injector 1, is prestressed by a sleeve 24.

On the discharge-side of armature 20 is a second flange 31, which is used as lower armature stop. It is connected via a welding seam 33 to valve needle 3 in force-locking manner. An elastic intermediate ring 32 is positioned between armature 20 and second flange 31 to damp armature bounce during closing of fuel injector 1.

Fuel channels 30*a* through 30*c* run through valve needle guide 14, armature 20 and valve seat member 5, and conduct the fuel, supplied via central fuel supply 16 and filtered by a filter element 25, to spray-discharge opening 7. Fuel injector 1 is sealed from a distributor line (not shown further) by a seal 28.

In the rest state of fuel injector 1, return spring 23 acts upon first flange 21 at valve needle 3 counter to its lift direction in such a way that valve-closure member 4 is retained in sealing contact against valve seat 6. Armature 20 rests on intermediate ring 32, which is supported on second flange 31. When magnetic coil 10 is energized, it builds up a magnetic field which moves armature 20 in the lift direction against the spring tension of return spring 23. Armature 20 carries along first flange 21, which is welded to valve needle 3, and thus valve needle 3 in the lift direction as well. Valve-closure member 4, being operatively connected to valve needle 3, lifts off from valve seat surface 6, and fuel guided via fuel channels 30*a* through 30*c* to spray-discharge opening 7 is sprayed off.

When the coil current is turned off, once the magnetic field has decayed sufficiently, armature 20 falls away from internal pole 13 due to the pressure of restoring spring 23 on first flange 21, whereupon valve needle 3 moves in a direction counter to the lift. As a result, valve-closure member 4 comes to rest on valve-seat surface 6, and fuel injector 1 is closed. Armature 20 comes to rest on the armature stop formed by second flange 31.

Figure 2A:
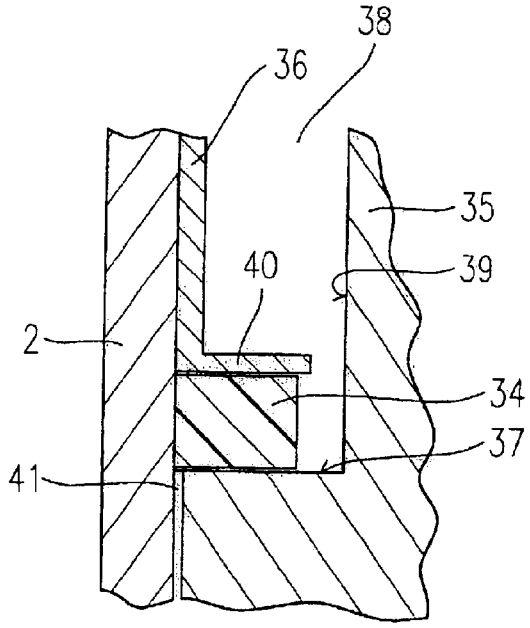
FIG. 2A shows a first view of a schematic cut-away portion in area II in FIG. 1 from the first exemplary embodiment of the fuel injector according to the present invention.
Figure 2B:
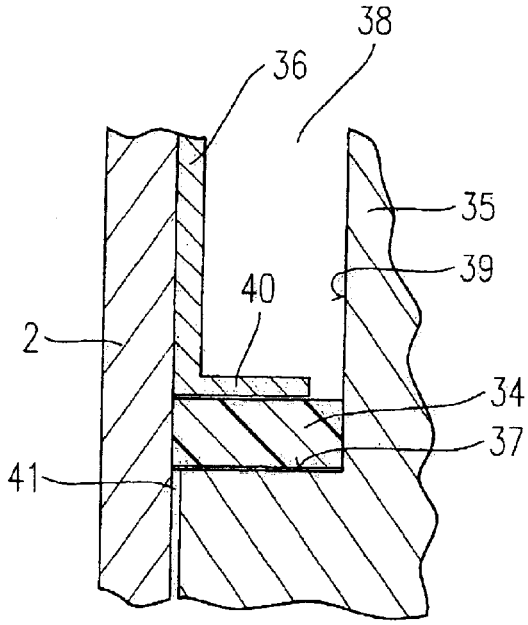
FIG. 2B shows a second view of a schematic cut-away portion in area II in FIG. 1 from the first exemplary embodiment of the fuel injector according to the present invention.

FIGS. 2A and 2B show, in a partial sectional view, the section designated by II in FIG. 1 from fuel injector 1 as constructed according to the present invention, in various states of assembly. Identical parts are provided with the same reference numerals in all of the figures.

As already mentioned in the description in connection with FIG. 1, sealing ring 34 is so designed in its radial extension that it is insertable into receiving bore 38 of cylinder head 35 by fuel injector 1, without this requiring any force. As soon as sealing ring 34 comes to rest at shoulder 37 of receiving bore 38, no further axial displacement of sealing ring 34 is possible any longer. However, since fuel injector 1 has not yet been pressed far enough into receiving bore 38 of cylinder head 35 to, for instance, terminate flush with cylinder head 35, the further installation requires the use of more force, with a reduction of the axial extension of sealing ring 34. This is accomplished by a radial disk-shaped extension 40 of stamping sleeve 36, bent at a right angle, for instance, which is positioned on sealing ring 34 on the inflow side. As a result of the force thus applied during installation, sealing ring 34 becomes increasingly flatter in the axial direction while it expands in the radial direction. Sealing ring 34 is subsequently deformed so that it abuts against a wall 39 of receiving bore 38. In this manner, the sealing effect of sealing ring 34 designed according to the present invention, may be reliably achieved by radial compression. This process is carried out until fuel injector 1 terminates flush, for instance, with cylinder head 35. Finally, fuel injector 1 is fixed in cylinder head 35 by appropriate measures, so that sealing ring 34 is maintained in the compressed form. The pressing-in path of fuel injector 1, which requires an increased expenditure of force, is greatly reduced compared to conventional sealing rings 34.

Since the combustion-chamber pressure on the combustion-chamber side of sealing ring 34 is greater than the ambient pressure on the side of sealing ring 34 facing away from the combustion chamber, sealing ring 34 is acted upon by combustion-chamber pressure, via a gap 41 between nozzle body 2 and cylinder head 35, so that the sealing effect is increased during the operation of fuel injector 1.

Figure 3A:
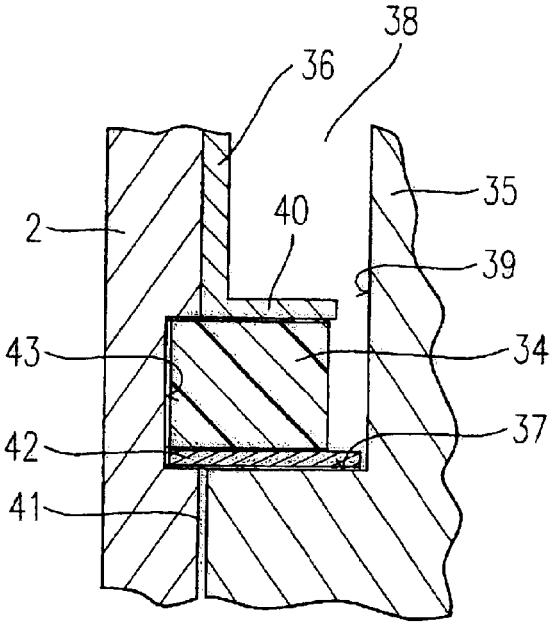
FIG. 3A shows a first view of a schematic cut-away portion in the same area as FIGS. 2A and 2B from a second exemplary embodiment of a fuel injector designed according to the present invention.
Figure 3B:
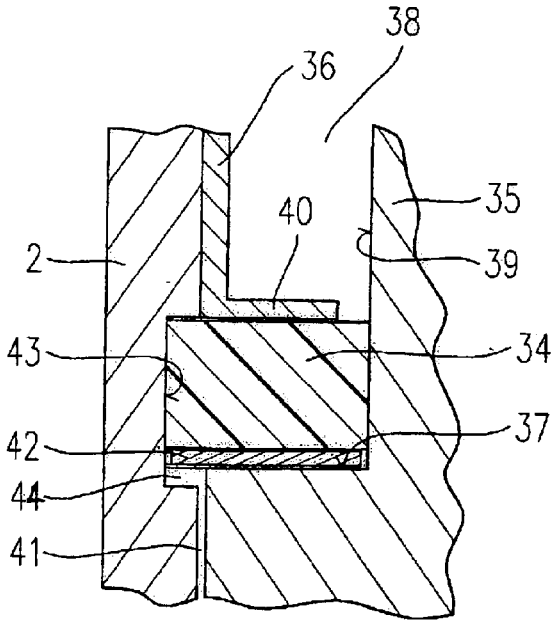
FIG. 3B shows a second view of a schematic cut-away portion in the same area as FIGS. 2A and 2B from a second exemplary embodiment of a fuel injector designed according to the present invention.

FIGS. 3A and 3B show a schematic section in the same region as FIGS. 2A and 2B from a second exemplary embodiment of a fuel injector 1 configured according to the present invention. Previously described components are not described again.

In order to obtain a more even loading of sealing ring 34, and to prevent sealing ring 34 from being pressed into gap 41, it is also possible to dispose a washer 42 as support on the discharge side of sealing ring 34, as shown in FIGS. 3A and 3B. Moreover, using washer 42 prevents direct contact of sealing ring 34 with the mixtures present in the combustion chamber, which may have a corrosive effect on sealing ring 34.

Additionally, sealing ring 34 may also be partially inserted into a grooved recess 43 of nozzle body 2, in order to increase the radial compressibility. If fuel injector 1 is then installed with sealing ring 34 attached thereto, as explained in the previous exemplary embodiment, sealing ring 34 is again radially compressed by extension 40 of stamping sleeve 36, this time supported by recess 43 of nozzle body 2 and washer 42 disposed on the discharge side.

In this case, as well, the sealing effect of sealing ring 34 is increased by the combustion-chamber pressure via gap 41 between cylinder head 35 and nozzle body 2. Due to a ring gap 44, produced after the compression in recess 43, this effect is only heightened further.

The present invention is not limited to the represented exemplary embodiments and is also applicable to other forms of sealing rings 34 and also for any construction types of fuel injectors 1, for instance, for fuel injectors 1 with connection to an intake manifold or a common rail system.

What is claimed is:

1. A fuel injector for a direct injection of a fuel, comprising:

a valve housing formed by a nozzle body;

a sealing ring that seals the fuel injector from a cylinder head of an internal combustion engine; and a stamping sleeve including a radial extension that acts upon the sealing ring in a final state of installation, the stamping sleeve being disposed on an intake side of the sealing ring such that an axial extension of the sealing ring is reduced in favor of a radial extension of the sealing ring relative to an unstrained state of the sealing ring.

2. The fuel injector as recited in claim 1, wherein:

the internal combustion engine includes a mixture-compressing internal combustion engine having an external ignition, and the direct injection of the fuel is into a combustion chamber of the mixture-compressing internal combustion engine.

3. The fuel injector as recited in claim 1, wherein:

the sealing ring is supported on a shoulder of a receiving bore of the cylinder head.

4. The fuel injector as recited in claim 1, wherein:

the radial extension of the sealing ring is smaller prior to installation than a receiving bore formed between the nozzle body and the cylinder head.

5. The fuel injector as recited in claim 1, wherein:

the stamping sleeve is tubular in shape and is slid onto the nozzle body.

6. The fuel injector as recited in claim 5, wherein:

the stamping sleeve is supported on a housing-end section of the fuel injector.

7. The fuel injector as recited in claim 3, further comprising:

a washer disposed between the shoulder of the receiving bore and the sealing ring.

8. The fuel injector as recited in claim 1, wherein:

the sealing ring is partially disposed in an outer recess of the nozzle body.

* * * * *